US006234340B1

(12) United States Patent
Bannister

(10) Patent No.: US 6,234,340 B1
(45) Date of Patent: May 22, 2001

(54) INSULATED COSMETIC CASE DEVICE

(76) Inventor: Nicole Bannister, 6014 E. Crater Lake Ave., Orange, CA (US) 92867

( * ) Notice: Subject to any disclaimer, the term of this patent is extended or adjusted under 35 U.S.C. 154(b) by 0 days.

(21) Appl. No.: 09/522,502

(22) Filed: Mar. 10, 2000

(51) Int. Cl.[7] ..... B65D 21/02

(52) U.S. Cl. ..... 220/592.2; 220/23.83; 206/581

(58) Field of Search ..... 220/592.24, 592.2, 220/23.83; 206/581

(56) References Cited

U.S. PATENT DOCUMENTS 2,591,151 * 4/1952 Hansen et al. .
3,025,947 * 3/1962 Hammer .
3,327,841 * 6/1967 Schurman .
4,085,785 * 4/1978 Hoot ..... 220/410
5,655,553 * 8/1997 Giese et al. ..... 132/303

* cited by examiner

*Primary Examiner*—Stephen Castellano

(57) ABSTRACT

A insulated cosmetic case device for holding a variety of cosmetic articles within a temperature moderated climate. The insulated cosmetic case device includes a housing having a bottom wall. The bottom wall has a top surface and a peripheral edge. A peripheral wall extends upward from and is integrally coupled to the peripheral edge of the bottom wall. The peripheral wall is substantially hollow such that the peripheral wall has a hollow space therein. An insulating material insulates the housing. The insulating material is positioned in the hollow space of the peripheral wall. A lid member selectively closes the housing. The lid member has a front edge and a back edge. The back edge is hingedly coupled to the a top edge of the peripheral wall. A container for organizing items in the housing has a bottom wall and a peripheral wall. The bottom wall has a shape adapted to fit in the housing such that the peripheral wall of the container is abutted against and interior surface of the peripheral wall of the housing. The container has internal walls therein, which define compartments in the container.

7 Claims, 2 Drawing Sheets

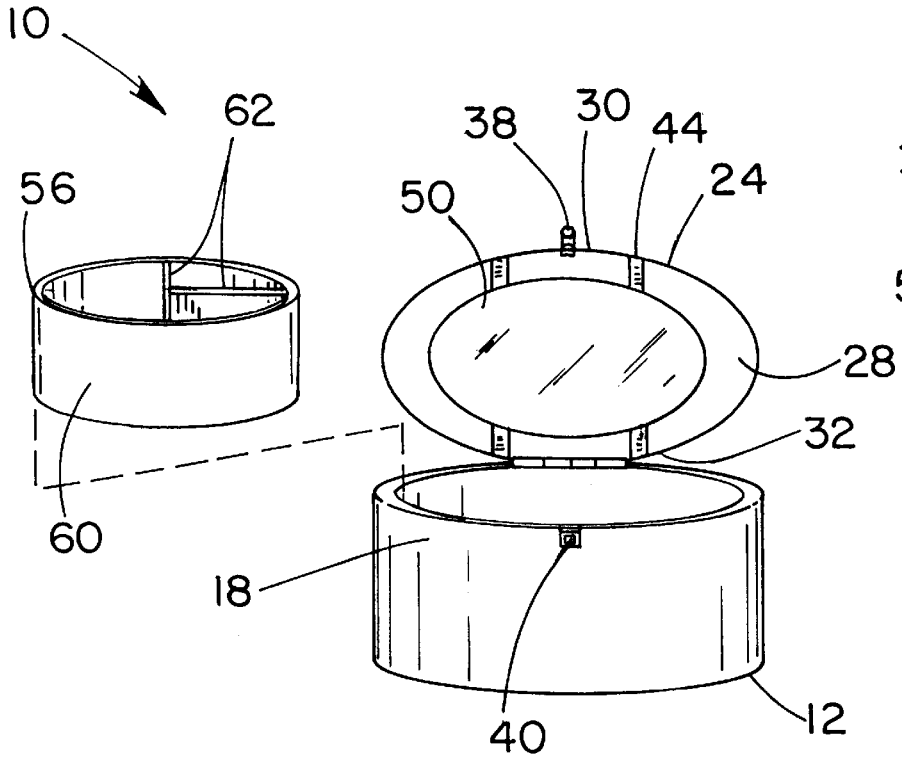
FIG 1
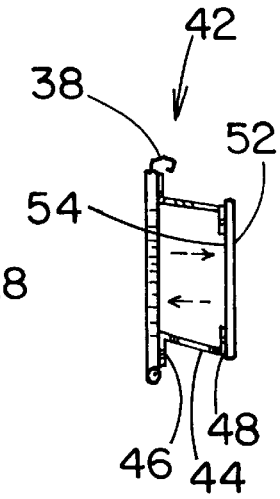
FIG 5
FIG 2
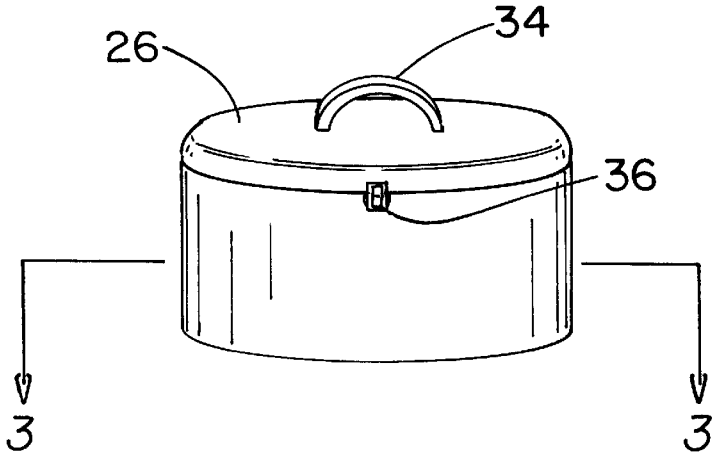

FIG 3
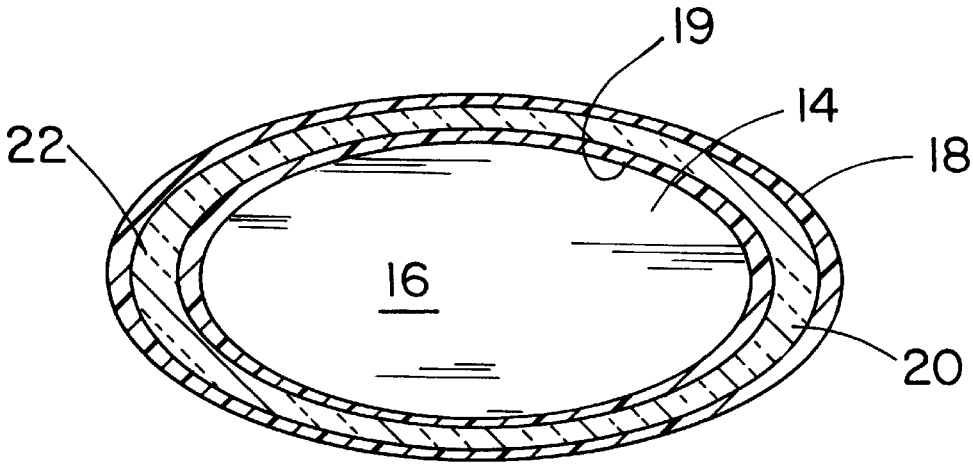
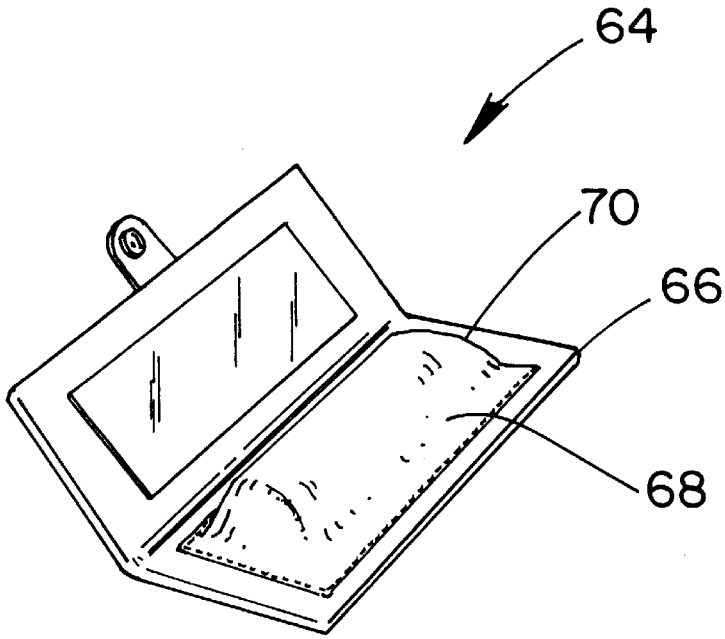
FIG 4

INSULATED COSMETIC CASE DEVICE

BACKGROUND OF THE INVENTION

1. Field of the Invention

The present invention relates to cosmetic cases and more particularly pertains to a new insulated cosmetic case device for holding a variety of cosmetic articles within a temperature moderated climate.

2. Description of the Prior Art

The use of cosmetic cases is known in the prior art. More specifically, cosmetic cases heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,353,600; 5,237,838; U.S. Des. Pat. No. 258,324; U.S. Pat. Nos. 5,524,440; 4,892,226; and 4,706,472.

While these devices fulfill their respective, particular objectives and requirements, the aforementioned patents do not disclose a new insulated cosmetic case device. The inventive device includes a housing having a bottom wall. The bottom wall has a top surface and a peripheral edge. A peripheral wall extends upward from and is integrally coupled to the peripheral edge of the bottom wall. The peripheral wall is substantially hollow such that the peripheral wall has a hollow space therein. An insulating material insulates the housing. The insulating material is positioned in the hollow space of the peripheral wall. A lid member selectively closes the housing. The lid member has a front edge and a back edge. The back edge is hingedly coupled to the a top edge of the peripheral wall. A container for organizing items in the housing has a bottom wall and a peripheral wall. The bottom wall has a shape adapted to fit in the housing such that the peripheral wall of the container is abutted against and interior surface of the peripheral wall of the housing. The container has internal walls therein, which define compartments in the container.

In these respects, the insulated cosmetic case device according to the present invention substantially departs from the conventional concepts and designs of the prior art, and in so doing provides an apparatus primarily developed for the purpose of holding a variety of cosmetic articles within a temperature moderated climate.

SUMMARY OF THE INVENTION

In view of the foregoing disadvantages inherent in the known types of cosmetic cases now present in the prior art, the present invention provides a new insulated cosmetic case device construction wherein the same can be utilized for holding a variety of cosmetic articles within a temperature moderated climate.

The general purpose of the present invention, which will be described subsequently in greater detail, is to provide a new insulated cosmetic case device apparatus and method which has many of the advantages of the cosmetic cases mentioned heretofore and many novel features that result in a new insulated cosmetic case device which is not anticipated, rendered obvious, suggested, or even implied by any of the prior art cosmetic cases, either alone or in any combination thereof.

To attain this, the present invention generally comprises a housing having a bottom wall. The bottom wall has a top surface and a peripheral edge. A peripheral wall extends upward from and is integrally coupled to the peripheral edge of the bottom wall. The peripheral wall is substantially hollow such that the peripheral wall has a hollow space therein. An insulating material insulates the housing. The insulating material is positioned in the hollow space of the peripheral wall. A lid member selectively closes the housing. The lid member has a front edge and a back edge. The back edge is hingedly coupled to the a top edge of the peripheral wall. A container for organizing items in the housing has a bottom wall and a peripheral wall. The bottom wall has a shape adapted to fit in the housing such that the peripheral wall of the container is abutted against and interior surface of the peripheral wall of the housing. The container has internal walls therein, which define compartments in the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulated cosmetic case device apparatus and method which has many of the advantages of the cosmetic cases mentioned heretofore and many novel features that result in a new insulated cosmetic case device which is not anticipated, rendered obvious, suggested, or even implied by any of the prior art cosmetic cases, either alone or in any combination thereof.

It is another object of the present invention to provide a new insulated cosmetic case device which may be easily and efficiently manufactured and marketed.

It is a further object of the present invention to provide a new insulated cosmetic case device which is of a durable and reliable construction.

An even further object of the present invention is to provide a new insulated cosmetic case device which is susceptible of a low cost of manufacture with regard to both materials and labor, and which accordingly is then susceptible of low prices of sale to the consuming public, thereby making such insulated cosmetic case device economically available to the buying public.

Still yet another object of the present invention is to provide a new insulated cosmetic case device which provides in the apparatuses and methods of the prior art some of the advantages thereof, while simultaneously overcoming some of the disadvantages normally associated therewith.

Still another object of the present invention is to provide a new insulated cosmetic case device for holding a variety of cosmetic articles within a temperature moderated climate.

Yet another object of the present invention is to provide a new insulated cosmetic case device which includes a housing having a bottom wall. The bottom wall has a top surface and a peripheral edge. A peripheral wall extends upward from and is integrally coupled to the peripheral edge of the bottom wall. The peripheral wall is substantially hollow such that the peripheral wall has a hollow space therein. An insulating material insulates the housing. The insulating material is positioned in the hollow space of the peripheral wall. A lid member selectively closes the housing. The lid member has a front edge and a back edge. The back edge is hingedly coupled to the a top edge of the peripheral wall. A container for organizing items in the housing has a bottom wall and a peripheral wall. The bottom wall has a shape adapted to fit in the housing such that the peripheral wall of the container is abutted against and interior surface of the peripheral wall of the housing. The container has internal walls therein, which define compartments in the container.

Still yet another object of the present invention is to provide a new insulated cosmetic case device that has a removably container for organizing cosmetics therein.

Even still another object of the present invention is to provide a new insulated cosmetic case device that a latch thereon for selectively locking the housing and lid in a closed position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new insulated cosmetic case device according to the present invention.

FIG. 2 is a schematic perspective view of the present invention.

FIG. 3 is a schematic plan view taken alone line 2—2 of the present invention.

FIG. 4 is a schematic perspective view of an insulated lipstick container of the present invention.

FIG. 5 is a schematic side view of the mirror assembly of the present invention.

DESCRIPTION OF THE PREFERRED EMBODIMENT

With reference now to the drawings, and in particular to FIGS. 1 through 5 thereof, a new insulated cosmetic case device embodying the principles and concepts of the present invention and generally designated by the reference numeral 10 will be described.

As best illustrated in FIGS. 1 through 5, the insulated cosmetic case device 10 generally comprises a housing 12. The housing has a bottom wall 14. The bottom wall has a top surface 16 and a peripheral edge. Preferably, the bottom wall 14 has a generally oval shape. A peripheral wall 18 extends upwardly from and is integrally coupled to the peripheral edge of the bottom wall 14. The peripheral wall 18 is substantially hollow such that the peripheral wall has a hollow space 20 therein.

An insulating material 22 for insulating the housing 12 is positioned in the hollow space 20 of the peripheral wall 18. The insulating material 22 substantially fills the hollow space 20. The insulating material 22 may be any conventional insulating material.

A lid member 24 selectively closes the housing 12. The lid member 24 has a top side 26 and a bottom side 28. The lid member 24 is generally hollow such that the lid member 24 has a hollow portion, not shown. The insulating material 22 substantially fills the hollow portion. The bottom side 28 has a size and shape substantially identical to the top surface 16 of the bottom wall 14. The lid member 24 has a front edge 30 and a back edge 32. The back edge 32 is hingedly coupled to a top edge of the peripheral wall 18. The top side 26 has a handle 34 thereon for carrying the housing 12.

A latch assembly 36 selectively locks the lid member 24 in a closed position. The latch assembly 36 has a male portion 38 and a female portion 40. The male portion 38 is fixedly coupled to the front edge 30 of the lid member 24. The female portion 40 is fixedly coupled to the peripheral wall 18. The female portion 40 is located such that the male portion 38 is in communication with the female portion 40 when the lid member 24 is in a closed position.

A mirror assembly 42 includes a plurality of straps 44. Each of the straps 44 has a first end 46 and a second end 48. The first end 46 of each of the straps 44 is fixedly coupled to the bottom side 28 of the lid member 24. Each of the straps 44 ideally comprises an elastic material. The plurality of straps 44 preferably includes four straps.

A mirror 50 has a reflective side 52 and a mounting side 54. Each of the second ends 48 of the straps 44 is removably securable to the mounting side 54 of the mirror 50. This can be accomplished with clips or any other conventional securing means.

A container 56, which is removable from the housing 12, for organizing items in the housing 12 has a bottom wall, not shown, and a peripheral wall 60. The bottom wall has a shape adapted to fit in the housing 12 such that the peripheral wall 60 of the container 56 is abutted against an interior surface 19 of the peripheral wall 18 of the housing 12. The container 56 has internal walls 62, which define compartments in the container.

An insulated lipstick container 64 includes a base portion 66 and a panel portion 68 fixedly secured to the base portion 66. The panel portion 68 has an opening 70 therein for receiving lipstick. The panel portion 68 is comprised of insulating material.

In use, the device 10 is used as any cosmetic container, however the housing 12 is insulated to protect cosmetics when they are in a warm environment which may melt or cause other harm to the cosmetics.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulated cosmetic case device, said device comprising:

a housing, said housing comprising:

a bottom wall, said bottom wall having a top surface and a peripheral edge;

a peripheral wall extending upward from and integrally coupled to said peripheral edge of said bottom wall, said peripheral wall being substantially hollow such that said peripheral wall has a hollow space therein;

an insulating material for insulating said housing, said insulating material being positioned in said hollow space of said peripheral wall;

a lid member for selectively closing said housing, said lid member having a front edge and a back edge, said back edge being hingedly coupled to a top edge of said peripheral wall;

a container for organizing items in said housing, said container having a bottom wall and a peripheral wall, said bottom wall having a shape adapted to fit in said housing such that said peripheral wall of said container is abutted against an interior surface of said peripheral wall of said housing, said container having internal walls therein, said internal walls defining compartments in said containers;

said lid member having a top side, and a bottom side, said lid member being generally hollow such that said lid member has a hollow portion, said hollow portion being substantially filled by said insulating material, said bottom side having a size and shape substantially identical to said top surface of said bottom wall of said housing; and a mirror assembly, said mirror assembly comprising:

a plurality of straps, each of said straps having a first end and a second end, said first end of each of said straps being fixedly coupled to said bottom side of said lid member, each of said straps comprising an elastic material; and a mirror, said mirror having a reflective side and a mounting side, each of said second ends of said straps being removably securable to said mounting side of said mirror.

2. The insulted cosmetic case device as in claim 1, said bottom wall of said housing having a generally oval shape.

3. The insulated cosmetic case device as in claim 1, further comprising:

a latch assembly for selectively locking said lid member in a closed position, said latch assembly having a male portion and a female portion, said male portion being fixedly coupled to said front edge of said lid member, said female portion being fixedly coupled to said peripheral wall of said housing, said female portion being located such that said male portion is in communication with said female portion when said lid member is in a closed position.

4. An insulated cosmetic case device comprising:

a housing comprising:

a bottom wall having a top surface and a peripheral edge, and a peripheral wall extending upward from and integrally coupled to said peripheral edge of said bottom wall such that said bottom wall and said peripheral wall define an interior of said housing, said peripheral wall having a space formed therein;

an insulating material positioned in said space of said peripheral wall;

a lid member for selectively closing said interior of said housing, said lid member being pivotally coupled to said peripheral wall;

a container for organizing items in said interior of said housing, said container having a bottom wall and a peripheral wall, said bottom wall having a shape adapted to fit in said interior of said housing such that said peripheral wall of said container is positioned adjacent an interior surface of said peripheral wall of said housing, said container having internal walls therein, said internal walls defining compartments in said container;

said lid member having a top side and a bottom side, said lid member having a hollow space between said top and bottom sides, said hollow space being substantially filled by insulating material; and a mirror assembly comprising:

a mirror having a reflective side and a mounting side, said mounting side being positioned adjacent to the bottom side of said lid member; and a plurality of straps, each of said straps having a first end and a second end, said first end of each of said straps being fixedly coupled to said bottom side of said lid member, each of said straps comprising an elastic material, each of said second ends of said straps being removably securable to said mounting side of said mirror.

5. The insulated cosmetic case device as in claim 4, said bottom wall of said housing having a generally oval shape.

6. The insulated cosmetic case device as in claim 4, further comprising:

a latch assembly for selectively locking said lid member in a closed position, said latch assembly having a male portion and a female portion, said male portion being fixedly coupled to said lid member, said female portion being fixedly coupled to said peripheral wall of said housing, said female portion being located such that said male portion is in communication with said female portion when said lid member is in a closed position.

7. An insulated cosmetic case device, said device comprising:

a housing, said housing comprising:

a bottom wall, said bottom wall having a top surface and a peripheral edge, said bottom wall having a generally oval shape;

a peripheral wall extending upward from and integrally coupled to said peripheral edge of said bottom wall, said peripheral wall being substantially hollow such that said peripheral wall has a hollow space therein;

an insulating material for insulating said housing, said insulating material being positioned in said hollow space of said peripheral wall, said insulating material substantially filling said hollow space;

a lid member for selectively closing said housing, said lid member having a top side, and a bottom side, said lid member being generally hollow such that said lid member has a hollow portion, said hollow portion being substantially filled by said insulating material, said bottom side having a size and shape substantially identical to said top surface of said bottom wall, said lid member having a front edge and a back edge, said back edge being hingedly coupled to said a top edge of said peripheral wall;

a latch assembly for selectively locking said lid member in a closed position, said latch assembly having a male portion and a female portion, said male portion being fixedly coupled to said front edge of said lid member, said female portion being fixedly coupled to said peripheral wall, said female portion being located such that said male portion is in communication with said female portion when said lid member is in a closed position;

a mirror assembly, said mirror assembly comprising:

a plurality of straps, each of said straps having a first end and a second end, said first end of each of said straps being fixedly coupled to said bottom side of said lid member, each of said straps comprising an elastic material, said plurality of straps comprising four straps;

a mirror, said mirror having a reflective side and a mounting side, each of said second ends of said straps being removably securable to said mounting side of said mirror; and a container for organizing items in said housing, said container having a bottom wall and a peripheral wall, said bottom wall having a shape adapted to fit in said housing such that said peripheral wall of said container is abutted against and interior surface of said peripheral wall of said housing, said container having internal walls therein, said internal walls defining compartments in said container.

* * * * *